US009340908B2

(12) United States Patent
Boylan et al.

(10) Patent No.: US 9,340,908 B2
(45) Date of Patent: May 17, 2016

(54) LOW FORMALDEHYDE AND HIGH WET STRENGTH VINYL ACETATE ETHYLENE COPOLYMER AND VINYL ACETATE POLYMER DISPERSIONS

(75) Inventors: John Richard Boylan, Bethlehem, PA (US); Conrad William Perry, Wescosville, PA (US)

(73) Assignee: WACKER CHEMICAL CORPORATION, Adrian, MI (US)

( * ) Notice: Subject to any disclaimer, the term of this patent is extended or adjusted under 35 U.S.C. 154(b) by 11 days.

(21) Appl. No.: 13/313,437

(22) Filed: Dec. 7, 2011

(65) Prior Publication Data

US 2013/0149927 A1 Jun. 13, 2013

(51) Int. Cl.
*C08K 3/28* (2006.01)
*D04H 1/64* (2012.01)

(52) U.S. Cl.
CPC ..... *D04H 1/641* (2013.01); *D04H 1/64* (2013.01); *Y10T 442/20* (2015.04)

(58) Field of Classification Search
CPC ..... C08K 3/16; C08L 29/04; C09D 131/04; D04H 1/64; D04H 1/641; Y10T 442/20
See application file for complete search history.

(56) References Cited

U.S. PATENT DOCUMENTS

| | | | | |
|---|---|---|---|---|
| 3,380,851 | A | 4/1968 | Lindeman et al. | |
| 3,498,869 | A * | 3/1970 | Murakami et al. | 156/328 |
| 3,671,382 | A | 6/1972 | Pierce | |
| 3,679,544 | A | 7/1972 | Askikaga et al. | |
| 3,759,736 | A | 9/1973 | Jenny et al. | |
| 4,176,108 | A | 11/1979 | Caimi et al. | |
| 4,309,469 | A | 1/1982 | Varona | |
| 4,449,978 | A | 5/1984 | Iacoviello | |
| 4,481,250 | A * | 11/1984 | Cook et al. | 442/149 |
| 4,605,589 | A | 8/1986 | Orphanides | |
| 4,698,384 | A | 10/1987 | Mao | |
| 5,143,954 | A | 9/1992 | Hutton et al. | |
| 5,252,332 | A * | 10/1993 | Goldstein | 424/402 |
| 5,314,943 | A | 5/1994 | Steinwand | |
| 5,439,960 | A | 8/1995 | Mudge et al. | |
| 5,540,987 | A | 7/1996 | Mudge et al. | |
| 5,545,684 | A | 8/1996 | Jakob et al. | |
| 5,668,216 | A | 9/1997 | Kinkel et al. | |
| 5,907,011 | A | 5/1999 | Jakob et al. | |
| 6,390,305 | B1 | 5/2002 | Rabasco et al. | |
| 6,787,594 | B1 | 9/2004 | Goldstein et al. | |
| 7,153,791 | B2 | 12/2006 | Boylan et al. | |
| 7,247,586 | B2 | 7/2007 | Boylan et al. | |
| 7,285,504 | B2 | 10/2007 | Jones et al. | |
| 2003/0045191 | A1 * | 3/2003 | Goldstein et al. | 442/96 |
| 2005/0239359 | A1 * | 10/2005 | Jones | D04H 1/641 442/154 |
| 2007/0015423 | A1 * | 1/2007 | Jones et al. | 442/59 |

FOREIGN PATENT DOCUMENTS

| | | |
|---|---|---|
| EP | 0 237 643 A2 | 9/1987 |
| GB | 1177199 | 1/1970 |

OTHER PUBLICATIONS

Fox, T.G., "Influence of Diluent and of Copolymer Composition on the Glass Temperature of a Polymer System," Bull. Am. Physics Soc., 1(3), p. 123 1956.
John Wiley & Sons, Polymer Handbook, 2nd Edition, New York, 1975.
Shi, et al., Rui, "The effect of citric acid on the structural properties and cytotoxicity of the polyvinyl alcohol/starch films when molding at high temperature," *Carbohydrate Polymers*, 74:763-770, 2008.
Xu, Guozhong, "Wet Strength Improvements of Paper Via Crosslinking of Cellulose Using Polymeric Carboxylic Acids and Aldehydes," http://www.fcs.uga.edu/ss/docs/xu_guozhong_200112_phd.pdf, 2001, 158 pages.
Rodriguez, Luis, International Search Report and Written Opinion dated Mar. 6, 2013, for International Application No. PCT/US2012/066752, 11 pages.
Koegler-Hoffman, S., International Search Report and Written Opinion dated Mar. 4, 2013, for International Application No. PCT/US2012/066721, 9 pages.
Koegler-Hoffman, S., International Search Report and Written Opinion dated Mar. 4, 2013, for International Application No. PCT/US2012/066720, 9 pages.

* cited by examiner

*Primary Examiner* — Jeremy R Pierce
(74) *Attorney, Agent, or Firm* — RatnerPrestia

(57) ABSTRACT

An aqueous composition includes polyvinyl alcohol, an acid having a pKa of at most 4.0, and a dispersion of a polymer in which vinyl acetate units constitute at least 60 wt % of the polymer. The polymer does not contain units of any N-methylol-containing monomer, and at least a portion of the polyvinyl alcohol is present in the form of an emulsion stabilizer for the polymer. The wet strength of a fibrous nonwoven substrate can be increased by applying one or more aqueous compositions that together include polyvinyl alcohol, an acid having a pKa of at most 4.0, and a dispersion of a polymer as described above, followed by a final drying step. A fibrous nonwoven article can be prepared in this way.

12 Claims, No Drawings

LOW FORMALDEHYDE AND HIGH WET STRENGTH VINYL ACETATE ETHYLENE COPOLYMER AND VINYL ACETATE POLYMER DISPERSIONS

BACKGROUND OF THE INVENTION

Vinyl acetate ethylene (VAE) copolymer and vinyl acetate (VA) homopolymer dispersions containing N-methylolacrylamide (NMA) as a self-crosslinking functional monomer are often applied to nonwoven substrates to provide good dry and wet tensile strength, as well as good water absorptivity. Examples of such substrates include airlaid nonwoven substrates used for wet wipe end-use applications. Wet wipes have an aqueous composition, such as a lotion, impregnated into the substrate to afford a wet texture, and therefore must have good wet tensile strength.

During the NMA crosslinking, however, formaldehyde is produced as an undesirable by-product. In addition, in many cases formaldehyde is also present in the dispersion prior to crosslinking due to the use of sodium formaldehyde sulfoxylate (SFS) as a redox radical initiator in forming the VAE copolymer. Formaldehyde may also be present due to the use of certain preservatives. The presence of formaldehyde in the dispersion, as well as in the substrate after the crosslinking reaction, is, however, undesirable for both the manufacturer of the substrate as well as the end use consumer. Efforts to use VAE or VA resins not containing NMA or other crosslinking monomers, however, have typically resulted in insufficient wet tensile strength. Thus, a need exists for methods and compositions capable of providing acceptable wet and dry tensile strength while minimizing generation of formaldehyde.

U.S. Pat. No. 7,285,504 B2 discloses nonwoven binders with improved wet tensile strength based on vinyl acetate (co)polymer emulsions which are stabilized with polyvinyl alcohol. The improvement is achieved by incorporation of polyacrylic acid.

EP 0 237 643 A2 discloses formaldehyde-free vinyl acetate/ethylene N-acrylamidoglycolic acid copolymers useful as nonwoven binders.

In U.S. Pat. No. 5,143,954 a nonwoven binder with low-formaldehyde is described, employing an N-methylol functional polymer latex and a formaldehyde-scavenging agent.

U.S. Pat. No. 4,449,978 discloses nonwoven products having formaldehyde content of less than 50 ppm in the nonwoven. In the nonwoven binder N-methylol acrylamide is partially substituted by acrylamide. Ammonium chloride is disclosed as a suitable catalyst for inducing crosslinking of the N-methylol units.

U.S. Pat. No. 5,252,332 describes addition of weak acids like boric acid for the improvement of binders based on polyvinyl alcohol (PVOH). This patent describes a PVOH-containing VA or VAE that is used to impregnate a nonwoven, followed by drying. The boric acid is added in the lotion to provide temporary wet strength to the nonwoven when the nonwoven is wetted with the lotion.

Despite the abovementioned advances, there remains a need for simple and cost-effective ways of providing dry and wet tensile strength to nonwovens while minimizing or eliminating generation of formaldehyde.

SUMMARY OF THE INVENTION

In one aspect, the invention provides an aqueous composition that includes polyvinyl alcohol, an acid having a pKa of at most 4.0, and a dispersion of a polymer in which vinyl acetate units constitute at least 60 wt % of the polymer, wherein the polymer does not contain units of any N-methylol-containing monomer, and wherein at least a portion of the polyvinyl alcohol is present in the form of an emulsion stabilizer for the polymer.

In another aspect, the invention provides a method of increasing the wet strength of a fibrous nonwoven substrate. The method includes applying to the substrate one or more aqueous compositions that together include polyvinyl alcohol, an acid having a pKa of at most 4.0, and a dispersion of a polymer in which vinyl acetate units constitute at least 60 wt % of the polymer, followed by a final drying step, wherein the polymer does not contain units of any N-methylol-containing monomer, and wherein at least a portion of the polyvinyl alcohol is present in the form of an emulsion stabilizer for the polymer.

In yet another aspect, the invention provides a fibrous nonwoven article prepared by the foregoing method.

DETAILED DESCRIPTION OF THE INVENTION

It has now been found that VA and VAE emulsions containing polyvinyl alcohol (PVOH) and a small amount of a suitable acid provide good nonwoven wet/dry strength, even in the absence of NMA or other formaldehyde-producing comonomers. The improvement in the nonwoven wet tensile strength requires the presence of PVOH as an emulsion stabilizer, and is believed to occur with any PVOH-stabilized VAE dispersion, but only if a suitable acid is included. While the use of acids is known in the art to facilitate wet strength increases in VAE polymers that include NMA or other crosslinkable methylol-containing monomer units, it is wholly unexpected that VAE or VA dispersions not containing such monomer units can show increased wet strength if an appropriate acid is added.

The invention therefore provides good wet strength with little or no generation of formaldehyde. Both VA and VAE dispersions are suitable for use according to the invention, but for simplicity the dispersion or polymer may be referred to herein as a VAE dispersion or polymer and it will be understood that such use of the term "VAE" includes VA unless the context clearly indicates otherwise.

VAE Dispersions

If a VAE (rather than VA) is used, the vinyl acetate fraction is at least 60%, typically from 66% to 98% by weight, or from 68% to 95% by weight, or from 68% to 93% by weight, or from 68% to 92% by weight, based in each case on the total weight of the vinyl acetate and ethylene monomers. If the polymer does not include ethylene, the VA content is typically at least 70% by weight, or at least 80% by weight, or at least 90% by weight. If the VA content is less than 100%, the balance comprises one or more comonomers and/or one or more auxiliary monomers as described below.

The ethylene fraction is typically 2.0% to 34% by weight, more typically 5% to 32% by weight and most typically 8% to 32% by weight, based in each case on the total weight of the vinyl acetate and ethylene monomers.

Optionally, in some embodiments the range of available polymer properties may be extended by copolymerizing additional comonomers with vinyl acetate, or with vinyl acetate and ethylene. Typically, suitable comonomers are monomers with a single polymerizable olefinic group. Examples of such comonomers are vinyl esters of carboxylic acids having 3 to 18 C atoms. Preferred vinyl esters are vinyl propionate, vinyl butyrate, vinyl 2-ethylhexanoate, vinyl laurate, 1-methyl vinyl acetate, vinyl pivalate, and vinyl esters of a-branched monocarboxylic acids having 9 to 11 C atoms, examples being VEOVA9™ or VEOVA10™ esters (available from Momentive Specialty Chemicals, Houston, Tex.). Other suitable comonomers include esters of acrylic acid or methacrylic acid with unbranched or branched alcohols having 1 to 15 C atoms. Exemplary methacrylic esters or acrylic esters include methyl acrylate, methyl methacrylate, ethyl acrylate, ethyl methacrylate, propyl acrylate, propyl methacrylate, n-butyl acrylate, n-butyl methacrylate, 2-ethylhexyl acrylate and norbornyl acrylate. Other suitable comonomers include vinyl halides such as vinyl chloride, or olefins such as propylene. In general the further comonomers are copolymerized in an amount of 0.5 to 30 wt %, preferably 0.5 to 20 wt %, based on the total amount of comonomers in the copolymer.

Optionally, 0.05% to 10% by weight, based on the total amount of vinyl acetate and ethylene, of other monomers (auxiliary monomers) may additionally be copolymerized. Auxiliary monomers include a polymerizable olefinic group and at least one additional functional group, which may be an additional polymerizable olefinic group so as to provide crosslinking. Other functional groups may include reactive groups such as carboxylic or sulfonic acid groups.

Examples of auxiliary monomers are ethylenically unsaturated monocarboxylic and dicarboxylic acids, typically acrylic acid, methacrylic acid, fumaric acid and maleic acid; ethylenically unsaturated carboxamides and carbonitriles, typically acrylamide and acrylonitrile; monoesters and diesters of fumaric acid and maleic acid, such as the diethyl and diisopropyl esters, and also maleic anhydride, ethylenically unsaturated sulphonic acids and their salts, typically vinylsulphonic acid, 2-acrylamido-2-methylpropanesulphonic acid. Other examples are pre-crosslinking comonomers such as polyethylenically unsaturated comonomers, examples being divinyl adipate, diallyl maleate, allyl methacrylate or triallyl cyanurate. Also suitable are epoxy-functional comonomers such as glycidyl methacrylate and glycidyl acrylate. Other examples are silicon-functional comonomers, such as acryloyloxypropyltri(alkoxy)- and methacryloyloxypropyltri(alkoxy)silanes, vinyltrialkoxysilanes and vinylmethyldialkoxysilanes, alkoxy groups that may be present being, for example, methoxy, ethoxy and ethoxypropylene glycol ether radicals. Additional monomers comprise hydroxyl or CO groups, examples being methacrylic and acrylic hydroxyalkyl esters such as hydroxyethyl, hydroxypropyl or hydroxybutyl acrylate or methacrylate, and also compounds such as diacetoneacrylamide and acetylacetoxyethyl acrylate or methacrylate.

While some applications may favor the inclusion of additional monomers in the VAE, for example such as those listed above, it may nonetheless in some cases be advantageous to exclude certain monomers in making the polymeric binder, depending on the specific needs of a given application. In other cases, these monomers may be included up to a limit of 1.0 wt % of the polymeric binder. The excluded or limited monomers may include any one or more of the following: i-butoxy methylacrylamide; acrylamidoglycolic acid; acrylamidobutyraldehyde; dialkyl acetals of acrylamidobutyraldehyde; glycidyl-containing compounds (e.g., glycidyl (meth) acrylate, triglycidyl isocyanurate, etc.); ethylenically unsaturated phosphates, phosphonates or sulfates; ethylenically unsaturated silicon compounds; (meth)acrylamide or N-substituted substituted (meth)arcylamides; (meth)acrylic esters; vinyl ethers; acrylonitrile; butadiene; styrene; vinyltoluene; divinyl benzene and/or other olefinically unsaturated hydrocarbons other than ethylene; halogenated monomers (e.g., vinyl chloride); and esters of allyl alcohol.

Formaldehyde-releasing comonomers (for example, N-methylol-functional monomers) are excluded from the compositions of this invention. For the same reason, it may further be desired to exclude urea-formaldehyde, glycol uril, and other formaldehyde-generating moieties in the binder, and preferably in the entire composition. Thus in some embodiments, the composition is entirely free of formaldehyde-generating ingredients.

In some embodiments, only VA homopolymers and/or VAE copolymers not containing further comonomer units or auxiliary monomers are used in the compositions of the invention.

The choice of monomers or the choice of the proportions by weight of the comonomers is preferably made in such a way that, in general, a glass transition temperature Tg of from −30° C. to +35° C. results. The glass transition temperature Tg of the polymers can be determined in a known way by means of differential scanning calorimetry (DSC). The Tg can also be calculated approximately beforehand by means of the Fox equation. According to Fox T. G., Bull. Am. Physics Soc. 1, 3, page 123 (1956): $1/Tg=x1/Tg1+x2/Tg2+ \ldots +xn/Tgn$, where xn is the mass fraction (% by weight/100) of the monomer n and Tgn is the glass transition temperature in kelvin of the homopolymer of the monomer n. Tg values for homopolymers are given in the Polymer Handbook 2nd Edition, J. Wiley & Sons, New York (1975).

Polyvinyl Alcohol (PVOH)

Polyvinyl alcohols are partially hydrolysed or fully hydrolysed polyvinyl acetates having an average degree of hydrolysis of 80 to 99.9 mol %. Suitable PVOH may include ultra-low viscosity (3-4 cps for a 4% aqueous solution), low viscosity (5-6 cps for a 4% aqueous solution), medium viscosity (22-30 cps for a 4% aqueous solution) and high viscosity (45-72 cps for a 4% aqueous solution) varieties. Ultra-low viscosity PVOH has a mass-average degree of polymerization of 150-300 and a weight average molecular weight of 13,000-23,000. Low viscosity PVOH has a mass-average degree of polymerization of 350-650 and a weight average molecular weight of 31,000-50,000. Medium viscosity PVOH has a mass-average degree of polymerization of 1000-1500 and a weight average molecular weight of 85,000-124,000. High viscosity PVOH has a mass-average degree of polymerization of 1600-2200 and a weight average molecular weight of 146,000-186,000. Any polyvinyl alcohol (PVOH) may be used according to the invention. In some embodiments, the viscosity of the PVOH is ultra-low, low or medium.

Weight average molecular weight and degree of polymerization of polyvinyl alcohol is typically determined by using size exclusion chromatography/gel permeation chromatography measurement techniques. Viscosity of polyvinyl alcohol is typically measured on a 4% solids aqueous solution of the PVOH using a Floppier falling-ball viscometer (DIN 53 015) or an Ubbelohde viscometer (capillary viscometer, DIN 51 562 and DIN 53 012). It is international practice to state the viscosity of 4% aqueous polyvinyl alcohol solutions at 20° C.

In some embodiments, suitable examples of PVOH include partially hydrolysed polyvinyl acetates or mixtures of having an average degree of hydrolysis of 80 to 96 mol %. Particular preference is given to partially hydrolysed polyvinyl acetate having an average degree of hydrolysis of 86 to 90 mol %, typically in each case having a mass-average degree of polymerization of 150 to 2200. To adjust the viscosity of the resulting polymer dispersion it may be advantageous to use mixtures of polyvinyl alcohols with different degrees of polymerization, in which case the degrees of polymerization of the individual components may be smaller or greater than the mass-average degree of polymerization, of 150 to 2200, of the mixture.

In some embodiments, suitable PVOH examples include fully hydrolysed polyvinyl acetates, i.e., those having an average degree of hydrolysis of 96.1 to 99.9 mol %, typically having an average degree of hydrolysis of 97.5 to 99.5 mol %, alone or in mixtures with partially hydrolysed polyvinyl acetates, the fully hydrolysed examples typically having a mass-average degree of polymerization of 150 to 2200.

Alternatively, or in addition, in some embodiments it may be useful to employ modified polyvinyl alcohols. For example, these may include PVOH containing functional groups, such as acetoacetyl groups, for example, or PVOH comprising comonomer units, such as vinyl laurate-modified or VERSATIC™ acid vinyl ester-modified polyvinyl alcohols, for example. VERSATIC™ acid vinyl esters are available from Momentive Specialty Chemicals under the trade name VEOVA™, for example VEOVA™ 9 and VEOVA™ 10. Also suitable are ethylene-modified polyvinyl alcohols, which are known, for example, under the trade name EXCEVAL™ polymer (Kuraray America, Inc., Houston, Tex.). These can be used either alone or in combination with standard unsubstituted polyvinyl alcohols. Preferred ethylene-modified polyvinyl alcohols have an ethylene fraction of up to 12 mol %, preferably 1 to 7 mol % and more preferably 2 to 6 mol %; 2 to 4 mol % in particular. The mass-average degree of polymerization is in each case from 500 to 5000, preferably 2000 to 4500, and more preferably 3000 to 4000, based on molecular weight data obtained via Aqueous Gel Permeation Chromatography.

The average degree of hydrolysis is generally greater than 92 mol %, preferably 94.5 to 99.9 mol %, and more preferably 98.1 to 99.5 mol %. Of course, it is also possible, and may be advantageous, to use mixtures of different ethylene-modified polyvinyl alcohols, alone or in combination with partially hydrolysed and/or fully hydrolysed standard polyvinyl alcohols.

The PVOH serving as the emulsion stabilizer will typically be present at a level of 1 to 10 parts per 100 parts of polymer by weight. More typically, the level will be from 2 to 8 parts, or from 4 to 5 parts.

Preparation of VAE Dispersions

VAE dispersions stabilized with polyvinyl alcohol may be prepared by emulsion polymerization, typically at a temperature in a range from 40° C. to 100° C., more typically 50° C. to 90° C. and most typically 60° C. to 80° C. The polymerization pressure is generally between 40 and 100 bar, more typically between 45 and 90 bar, and may vary particularly between 45 and 85 bar, depending on the ethylene feed. Polymerization may be initiated using a redox initiator combination such as is customary for emulsion polymerization.

Redox initiator systems may be used to prepare VAE emulsions suitable for use according to the invention. The initiators may be formaldehyde-generating redox initiation systems such as sodium formaldehyde sulfoxylate. In some embodiments, however, it is desirable to minimize the formaldehyde level in the dispersion and therefore in the VAE bound nonwoven substrate. In such cases, it is desirable to use a VAE prepared with a non-formaldehyde generating redox initiation system. In general, suitable non-formaldehyde generating reducing agents for redox pairs include, as non-limiting examples, those based on ascorbic, bisulfite, erythorbate or tartaric chemistries as known in the art, and a commercial reducing agent known as BRUGGOLITE® FF6M manufactured by Bruggeman Chemical of Heilbronn, Germany. Non-redox initiators may also be used, such as persulfates, peroxides and azo-type initiators, all of which are well known in the art.

During polymerization the dispersion may be stabilized with polyvinyl alcohol (PVOH) or a combination of PVOH and a surfactant (emulsifier). The polyvinyl alcohol is present during the polymerization generally in an amount totalling 1% to 10% by weight, preferably 2% to 8% by weight, more preferably 4% to 5% by weight, based in each case on the total weight of the monomers.

It is preferable not to add emulsifiers in the polymerization. In exceptional cases it can be advantageous to make concomitant use of small amounts of emulsifiers, typically from 1 to 5% by weight, based on the amount of monomer. Suitable emulsifiers are either anionic or cationic or nonionic emulsifiers, for example anionic surfactants, such as alkyl sulfates whose chain length is from 8 to 18 carbon atoms, alkyl or alkylaryl ether sulfate having from 8 to 18 carbon atoms in the hydrophobic radical and up to 40 ethylene oxide or propylene oxide units, alkyl- or alkylarylsulfonates having from 8 to 18 carbon atoms, esters and half-esters of sulfosuccinic acid with monohydric alcohols or alkylphenols, or nonionic surfactants, such as alkyl polyglycol ethers or alkylaryl polyglycol ethers having from 8 to 40 ethylene oxide units. Preferably, these surfactants do not contain alkyl phenol ethoxylate structures and are not endocrine disruptors.

The solids content of suitable VAE dispersions are typically in a range from 45% to 75% by weight, but dispersions with other solids levels may be used.

Acids

A variety of acids can be formulated with the PVOH-containing VAE composition to provide increased wet strength, provided the pKa of the acid is sufficiently low, i.e., the acid strength is high enough. The pKa should be at most 4.0, or at most 3.5, or at most 2.5, or at most 2.0. Polymeric carboxylic acids are not suitable acids for purposes of the invention. Thus, for example, homopolymers or copolymers containing acrylic acid, maleic acid or fumaric acid units cannot constitute the acids required in compositions according to the invention, and thus these and/or other polymeric carboxylic acids may in some embodiments be excluded from the compositions of this invention.

In some embodiments, mineral acids or other inorganic or non-carboxylic acids are used. Nonlimiting examples include hydrochloric, nitric, sulfuric, phosphoric, and perchloric acid. Partial alkali metal or ammonium salts of di- or tri-protic acids may also be used. Nonlimiting examples include sodium, potassium and ammonium bisulfate, and monosodium, monopotassium and monoammonium phosphate.

Salts formed by reaction of acids with fugitive bases, such as ammonium chloride, in which the ammonia evaporates in use and leaves the acid (HCl) behind in the treated nonwoven, are considered to be acids for purposes of the invention. Reference to the pKa of such a salt will be understood to refer to the pKa of the acid itself (e.g., HCl, in the case of ammonium chloride). Nonlimiting examples of such acids include ammonium sulfate, ammonium chloride, and ammonium phosphate.

The amount of acid in the formulation will typically be at least 0.1 parts, or at least 0.2 parts, or at least 0.5 parts, or at least 1 part, measured as dry parts based per 100 parts of dry VAE polymer. Typically the amount will be at most 5 parts, or at most 4 parts, or at most 3 parts. In many cases, the wet strength appears to level out somewhere in the range of 1 to 3 parts.

The acid may be formulated with the VAE and the PVOH, or it may be added separately to a substrate treated with the VAE and the PVOH, either before or after drying the VAE and PVOH.

Treatment of Nonwoven Substrates

The VAE/PVOH/acid binder composition is typically applied to a nonwoven substrate via spray application, saturation, gravure printing or foaming. The formulation is typically applied at a solids level between 0.5 to 30% depending on the desired add-on. After the formulation is applied to the substrate, the substrate is dried. This is typically done at a temperature in a range from 120° C. to 160° C., but higher or lower temperatures may be used. A wetting additive can also be included in the treatment composition to aid in the wetting of not only the formulated binder on the substrate, but also wetting of the subsequent finished fibrous nonwoven substrate. One example is AEROSOL® OT sodium dioctyl sulfosuccinate (Cytec Industries Inc., West Paterson, N.J.). The wetting agent can be added into the formulation at level of 0.1 to 3 dry parts based on the weight of dry polymer but is more typically formulated at between 0.5 and 2 parts.

An alternative application method is to first apply the PVOH-containing VAE to the nonwoven substrate (with or without the wetting additive) and dry the binder on the substrate, and then apply the acid alone to the dried, VAE bound nonwoven and again dry the substrate. For each drying step individually, the temperature is typically in a range from 120° C. to 160° C., but higher or lower temperatures may be used.

The fibrous material used in the nonwoven substrate can be a natural fiber such as (but not limited to) cellulose fiber, or a synthetic fiber including but not limited to one or more of polyester, polyethylene, polypropylene and polyvinyl alcohol, or viscose fiber, or a combination of any of these. The fibrous nonwoven substrate itself can be produced according to any of various methods known in the art, including but not limited to airlaid, wet laid, carding, and hydroentanglement.

As seen in the following examples, nonwoven wet strength resulting from compositions according to the invention may be approximately 30% to 140% higher than that obtained from the nonwoven bound with the VAE and PVOH without any acid, and 50% to 170% higher than that obtained with acid treatment alone.

EXAMPLES

A series of binder emulsions suitable for spray application to nonwoven substrates was prepared, having the compositions described below.

Dispersion 1 was a PVOH-stabilized VAE dispersion having a solids content of 55 wt %, with the copolymer containing 82 wt % of vinyl acetate and 18 wt % of ethylene and having a glass transition temperature of 0° C. The dispersion was stabilized with 4.2 wt % of PVOH (88 mol-% degree of hydrolysis) based on copolymer weight. This dispersion was prepared using sodium formaldehyde sulfoxylate (SFS) as the radical initiator.

Dispersion 2 was a PVOH-stabilized VAE dispersion having a solids content of 55 wt %, with the copolymer containing 90 wt % of vinyl acetate and 10 wt % of ethylene and having a glass transition temperature of 17° C. The dispersion was stabilized with 3.9 wt % of PVOH (88 mol-% degree of hydrolysis) based on copolymer weight. This dispersion was prepared using a non-formaldehyde generating redox initiation system.

Dispersion 3 was a PVOH-stabilized VAE dispersion having a solids content of 55 wt %, with the copolymer containing 91 wt % of vinyl acetate and 9 wt % of ethylene and having a glass transition temperature of 23° C. The dispersion was stabilized with 2.8 wt % of PVOH (98 mol-% degree of hydrolysis) and with along with 1.5 wt % of PVOH (88 mol-% degree of hydrolysis), both based on copolymer weight. This dispersion was prepared using SFS as the radical initiator.

Dispersion 4 was a costabilized (both surfactant and PVOH) VAE dispersion having a solids content of 63%, with the copolymer containing 85.5 wt % of vinyl acetate and 14.5 wt % of ethylene and having a glass transition temperature of 5° C. The dispersion was stabilized with 3.0 wt % of PVOH (88 mol-% degree of hydrolysis) and with 2.5 wt % of an emulsifier, both based on copolymer weight. This dispersion was prepared using a non-formaldehyde generating redox initiation system.

Dispersion 5 was a vinyl acetate homopolymer dispersion having a solids content of 55 wt % and a glass transition temperature of 33° C. The dispersion was stabilized with 5 wt % of PVOH (88 mol-% degree of hydrolysis) based on VA homopolymer weight.

Dispersion 6 was an emulsifier-stabilized VAE dispersion (with no PVOH) having a solids content of 55 wt %, with the copolymer containing 85 wt % of vinyl acetate and 15 wt % of ethylene and having a glass transition temperature of +6° C. The dispersion was stabilized with 4.0 wt % of an emulsifier, based on copolymer weight. This dispersion was prepared using a non-formaldehyde generating redox initiation system.

Binder and PVOH Study

Dispersions 1-4 and 6 were formulated into compositions suitable for application to nonwoven substrates as follows, in each case producing a 20% nonvolatiles composition.

| Component | Dry Parts |
|---|---|
| Dispersion | 100 |
| Ammonium chloride | 0/1 |
| Wetting surfactant | 1 |

The wetting surfactant was AEROSOL® OT sodium dioctyl sulfosuccinate (Cytec Industries Inc., West Paterson, N.J.). Another aqueous composition was prepared, consisting only of 10 wt % of CELVOL® 504 PVOH (Celanese Chemicals, Dallas, Tex.) without ammonium chloride or AEROSOL® OT, which had a degree of hydrolysis of 88 mol-% and a weight average molecular weight of 13,000-50,000 and a number average molecular weight of 7,000-23,000. The mass-average degree of polymerization was between 150 and 650.

The compositions were applied to a 90 gsm airlaid substrate having 88 wt % cellulose fibers and 12 wt % synthetic bi-component fibers consisting of a polyester core and a polyethylene sheath, with and without the presence of 1 wt % ammonium chloride based on total polymer solids (defined as VAE or VA polymer, any emulsifier associated with the polymer, and any PVOH present). The compositions were sprayed onto both sides of the airlaid substrate and dried for 3 minutes at 150° C. in a Mathis through air dryer to produce a dry polymer add-on rate of 20% (dry polymer on dry substrate). The bound substrates were placed in a constant temperature and humidity room at 70° F. and 50% relative humidity and equilibrated for at least a 24 hour period prior to dry and wet tensile breaking strength testing according to ASTM method D 5035-95. The results are shown in Table 1, where Example numbers preceded by the letter "C" indicate comparative examples.

TABLE 1

| Example No. | Treatment | Add-on % | Substrate Basis Weight g/m$^2$ | Dry Tensile Strength g/5 cm | Wet Tensile Strength g/5 cm | % Wet Tensile Increase with acid addition | 50% Solids Dispersion Formaldehyde Level ppm |
|---|---|---|---|---|---|---|---|
| C1 | Dispersion 1 | 18.9 | 101.2 | 3613 | 566 | 45.4 | 126.8 |
| 2 | Dispersion 1 w $NH_4Cl$ | 19.8 | 100.2 | 3523 | 823 | | |
| C3 | Dispersion 2 | 20.1 | 100.3 | 4494 | 497 | 112.5 | 5.6 |
| 4 | Dispersion 2 w $NH_4Cl$ | 20.1 | 103.1 | 4354 | 1056 | | |
| C5 | Dispersion 3 | 19.5 | 101.7 | 4349 | 716 | 60.9 | 100.5 |
| 6 | Dispersion 3 w $NH_4Cl$ | 19.5 | 102.8 | 4263 | 1151 | | |
| C7 | Dispersion 4 | 20.3 | 101.3 | 2406 | 417 | 72.9 | 1.3 |
| 8 | Dispersion 4 w $NH_4Cl$ | 20.4 | 101.6 | 2276 | 721 | | |
| C9 | Dispersion 6 | 20.6 | 106.1 | 1818 | 453 | 0.0 | 4.7 |
| C10 | Dispersion 6 w $NH_4Cl$ | 20.8 | 102.7 | 1627 | 442 | | |
| C11 | PVOH | 12.7 | N/A | 3380 | 242 | 0.0 | N/A |
| C12 | PVOH w $NH_4Cl$ | 12.9 | N/A | 3201 | 207 | | |
| C13 | none | 0 | 89.2 | 811 | 346 | 20.0 | N/A |
| C14 | 1% $NH_4Cl$ | 1 | 90.1 | 765 | 420 | | |

As seen in Table 1, significant improvement in nonwoven wet tensile was seen when the compositions included a VAE resin, PVOH and an acid (ammonium chloride), compared with compositions where one or more of these ingredients was not included. Examples 2, 4, 6 and 8, which included all three components, showed much better wet tensile strength than the analogous compositions (Comparative Examples C1, C3, C5 and C7) in which ammonium chloride was omitted. In the absence of PVOH (Comparative Examples C9 and C10), the inclusion of ammonium chloride with the VAE had no noticeable effect on wet strength. In the absence of VAE (Comparative Examples C11 and C12), the inclusion of ammonium chloride with the PVOH had no noticeable effect on wet strength. Comparative Examples C13 and C14 illustrate the lack in wet tensile strength when ammonium chloride was applied as the only treatment component.

Table 1 also shows the dispersion formaldehyde levels provided by the various VAE's, measured according to ASTM D5910-96. As can be seen, it is possible to achieve very low formaldehyde levels while obtaining excellent strength, if one avoids the use of formaldehyde-generating ingredients such as sodium formaldehyde sulfoxylate (SFS) when preparing the dispersion. For example, Dispersions 2, 4 and 6 did not include formaldehyde-generating ingredients and had much lower formaldehyde levels than Dispersions 1 and 3, which used SFS as a redox radical initiator in forming the VAE copolymer Effect of Acid Strength The wet strength improvements observed with the addition of ammonium chloride to the PVOH-containing VAE were also observed with other sufficiently strong acids. Whatman filter paper was bound with various PVOH-stabilized VAE's formulated with ammonium chloride and with several other acids having pKa values as shown. The effective pKa for ammonium chloride is considered to be that of HCl, as ammonia is expected to volatilize readily upon drying such that HCl is left in the treated substrate.

| Acid | pKa |
|---|---|
| HCl | −4.0 |
| $NaHSO_4$ | 1.9 |
| $H_3PO_4$ | 2.15 |
| Citric | 3.13 |
| Acetic | 4.7 |

Pieces of Whatman filter paper bound with the various VAE/acid combinations were prepared by saturating samples of as received Whatman No. 4 filter paper with a 9% solids formulation of the VAE and acid formulation. Weights of $H_3PO_4$ and acetic acid refer to amounts of standard concentrated reagents. The acid was blended into the VAE at 1 part per 100 dry parts of total polymer solids (defined as VAE or VA polymer, any emulsifier associated with the polymer, and any PVOH present). The saturated papers were then pressed to remove excess formulation for a targeted add-on of 10% (dry on dry paper weight) and then dried in an oven at 160° C. for 6 minutes. The wet and dry tensile breaking strength was measured on an Instron tensile tester using ASTM method D 5035-95. The results are shown in Table 2.

TABLE 2

| | | No Acid | | Ammonium Chloride | | Citric Acid | | Sodium Bisulfate | | Phosphoric Acid | | Acetic Acid | |
|---|---|---|---|---|---|---|---|---|---|---|---|---|---|
| Example No. | Dispersion | Add-on % | Wet Tensile g/inch | Add-on % | Wet Tensile g/inch | Add-on % | Wet Tensile g/inch | Add-on % | Wet Tensile g/inch | Add-on % | Wet Tensile g/inch | Add-on % | Wet Tensile g/inch |
| 15 | 1 | 9.4 | 426 | 9.7 | 1028 | 9.7 | 620 | 9.6 | 848 | 9.5 | 1045 | 9.9 | 444 |
| 16 | 2 | 9.6 | 517 | 9.7 | 1335 | 9.5 | 756 | 9.6 | 1057 | 9.4 | 984 | 9.2 | 523 |

TABLE 2-continued

| Example No. | Dispersion | No Acid | | Ammonium Chloride | | Citric Acid | | Sodium Bisulfate | | Phosphoric Acid | | Acetic Acid | |
|---|---|---|---|---|---|---|---|---|---|---|---|---|---|
| | | Add-on % | Wet Tensile g/inch | Add-on % | Wet Tensile g/inch | Add-on % | Wet Tensile g/inch | Add-on % | Wet Tensile g/inch | Add-on % | Wet Tensile g/inch | Add-on % | Wet Tensile g/inch |
| 17 | 3 | 9.8 | 555 | 9.6 | 1440 | 9.5 | 739 | 9.9 | 1030 | 9.8 | 1437 | 9.4 | 526 |
| 18 | 5 | 9.1 | 530 | 9.3 | 1087 | N/A | N/A | N/A | N/A | N/A | N/A | N/A | N/A |
| 19 | none | N/A | 156 | N/A | N/A | N/A | N/A | N/A | N/A | N/A | N/A | N/A | N/A |

Add-on % refers to dispersion solids
Whatman Filter Paper 4CHR
Saturation Solution - 9%
1 dry part Acid addition per 100 dry parts of VAE dispersion.
160 C. Cure for 6 minutes
Whatman Filter Paper Basis Weight - 94.30 g/sq. meter The results shown in Table 2 demonstrate that certain acids other than ammonium chloride promote wet tensile strength improvements in paper and nonwovens bound with PVOH-stabilized VAE. Not all acids work, however. For example, the runs using acetic acid, which has a pKa of 4.7, failed to produce significant wet strength improvement because the acid strength was too low.

Dispersion 5, a VA homopolymer dispersion containing PVOH, showed substantial wet strength improvement when an acid (ammonium chloride) was included.

Effect of Ammonium Chloride Level

The influence of ammonium chloride content on the wet tensile strength of a PVOH-containing VAE (Dispersion 2) for treatment of an airlaid substrate, and for treatment of filter paper, can be seen in Tables 3 and 4, respectively. In these examples, the ammonium chloride was added at various levels starting at 0 dry parts up to 3 or 4 dry parts per 100 dry parts of total polymer solids (defined as VAE or VA polymer, any emulsifier associated with the polymer, and any PVOH present).

The formulations used in Table 3 were prepared at 20% solids and spray applied to the airlaid base substrate described in Example 1, targeting an add-on of 20% dry on dry substrate. After application the substrates were dried, conditioned and tested for dry and wet tensile breaking strength in the same manner as described in Example 1.

The formulations used in Table 4 were prepared at 9% solids and applied to the Whatman filter papers in the same manner as described in Example 2. The substrates were then dried, conditioned and tested for dry and wet breaking tensile strength in the same manner as described in Example 2.

TABLE 3

| Example No. | $NH_4Cl$ Additions parts addition dry on 100 parts dry of Dispersion 2 | % Add-on | Basis Weight g/m$^2$ | Dry Tensile grams/ 5 cm | Wet Tensile grams/ 5 cm |
|---|---|---|---|---|---|
| 20 | 0 parts $NH_4Cl$ | 19.1 | 99.6 | 2723 | 529 |
| 21 | 0.25 parts $NH_4Cl$ | 19.5 | 99.6 | 2821 | 784 |
| 22 | 0.50 parts $NH_4Cl$ | 19.7 | 100.5 | 2780 | 849 |
| 23 | 1.0 parts $NH_4Cl$ | 19.8 | 100.6 | 2751 | 943 |

TABLE 3-continued

| Example No. | $NH_4Cl$ Additions parts addition dry on 100 parts dry of Dispersion 2 | % Add-on | Basis Weight g/m$^2$ | Dry Tensile grams/ 5 cm | Wet Tensile grams/ 5 cm |
|---|---|---|---|---|---|
| 24 | 2.0 parts $NH_4Cl$ | 19.2 | 101.7 | 2747 | 1037 |
| 25 | 3.0 parts $NH_4Cl$ | 19.7 | 96.1 | 2770 | 1057 |

Airlaid substrate - 12% bicomponent fiber, 88% cellulose fiber
Drying conditions - 3 minutes @ 320 F.

TABLE 4

| Example No. | $NH_4Cl$ Additions dry parts on 100 dry parts of Dispersion 2 | % Add-on | Basis Weight g/m$^2$ | Dry Tensile grams/ inch | Wet Tensile grams/ inch |
|---|---|---|---|---|---|
| 26 | Base Sheet | 0.0 | 94.3 | 4167 | 143 |
| 27 | 0 parts $NH_4Cl$ | 9.6 | 94.5 | 7446 | 504 |
| 28 | 0.25 parts $NH_4Cl$ | 9.3 | 94.6 | 6974 | 676 |
| 29 | 0.50 parts $NH_4Cl$ | 9.3 | 94.2 | 7402 | 891 |
| 30 | 1.0 parts $NH_4Cl$ | 9.3 | 94.9 | 6870 | 959 |
| 31 | 2.0 parts $NH_4Cl$ | 9.4 | 94.7 | 7315 | 1251 |
| 32 | 3.0 parts $NH_4Cl$ | 9.5 | 94.4 | 6844 | 1264 |
| 33 | 4.0 parts $NH_4Cl$ | 9.5 | 95.4 | 6824 | 1269 |

Whatman Filter Paper 4CHR
Saturation Solution - 9%
1% by weight Acid addition (dry on dry dispersion)
160 C. Cure for 6 minutes
Whatman Filter Paper Basis Weight - 94.30 g/sq. meter In the examples illustrated in Tables 3 and 4, wet tensile strength improved with increasing amounts of ammonium chloride up to a level of about 2 to 3 dry parts, after which the wet strength appeared to level off. While these amounts appear optimal for the combination of Dispersion 2 and ammonium chloride, other levels may be better for other dispersions and/or other acids.

Control Experiments

To demonstrate that the improvements to the nonwoven wet tensile strength are not due to the acid addition alone, several airlaid webs treated with increasing amounts of ammonium chloride only were measured for tensile breaking strength. The ammonium chloride was spray applied to airlaid substrate described in Example 1 at concentration levels of 0.1 to 1.0%. The substrates were dried, conditioned and tested for dry and wet breaking tensile strength in the same manner as described in Example 2. The results of the tensile measurements are shown in Table 5.

TABLE 5

| Example No. | $NH_4Cl$ Solution Concentrations | % Add-on | Basis Weight $g/m^2$ | Dry Tensile grams/ 5 cm | Wet Tensile grams/ 5 cm |
|---|---|---|---|---|---|
| 34 | 0% $NH_4Cl$ | 0.0 | 88.6 | 764 | 381 |
| 35 | 0.1% $NH_4Cl$ | N/A | 88.3 | 968 | 322 |
| 36 | 0.3% $NH_4Cl$ | 0.2 | 87.5 | 903 | 294 |
| 37 | 0.5% $NH_4Cl$ | 0.4 | 88.9 | 792 | 253 |
| 38 | 1.0% $NH_4Cl$ | 0.8 | 89.7 | 797 | 307 |

Airlaid substrate - 12% bicomponent fiber, 88% cellulose fiber
Drying conditions - 3 minutes @ 320° F.

As shown in Table 5, wet tensile of the airlaid substrates with increasing ammonium chloride levels did not increase beyond that of the base substrate having no ammonium chloride. Thus, ammonium chloride by itself had no influence on wet tensile strength.

To determine whether improved wet strength could be obtained if the PVOH in the composition were added separately rather than as a colloidal emulsion stabilizer for the VAE, evaluations similar to those in Table 1 were performed in which Dispersion 6, a VAE stabilized only with a surfactant, was combined with 1% $NH_4Cl$ only (Example 39) and with both 1% $NH_4Cl$ and 4.5% CELVOL® 504 PVOH, both based on polymer weight. Testing results are shown in Table 6. It can be seen that the addition of PVOH separately, and not as part of the VAE emulsion stabilizer, had no effect on wet or dry tensile strength even in the presence of a suitable catalytic acid.

TABLE 6

| Example No. | Treatment | Add-on % | Substrate Basis Weight $g/m^2$ | Dry Tensile Strength g/5 cm | Wet Tensile Strength g/5 cm | % Wet Tensile Increase with PVOH addition | 50% Solids Dispersion Formaldehyde Level ppm |
|---|---|---|---|---|---|---|---|
| 39 | Dispersion 6 | 18.7 | 104.2 | 2087 | 390 | 0 | 4.7 |
| 40 | Dispersion 6 w PVOH | 18.6 | 103.7 | 1995 | 394 | | |

Although the invention is illustrated and described herein with reference to specific embodiments, the invention is not intended to be limited to the details shown. Rather, various modifications may be made in the details within the scope and range of equivalents of the claims without departing from the invention.

What is claimed:

1. An aqueous composition comprising polyvinyl alcohol, a mineral acid or an ammonium salt thereof, wherein the mineral acid has a pKa of at most 4.0, and an aqueous dispersion of a polymer in which vinyl acetate units constitute at least 60 wt % of the polymer, wherein the composition does not contain units of any N-methylol-containing monomer, wherein at least a portion of the polyvinyl alcohol is present in the form of an emulsion stabilizer for the polymer, and wherein the aqueous composition is suitable for application to a non-woven substrate to increase its wet tensile strength.

2. The composition of claim 1, wherein the mineral acid or ammonium salt thereof is ammonium chloride.

3. The composition of claim 1, wherein the polymer is a vinyl acetate ethylene copolymer.

4. The composition of claim 1, wherein all of the polyvinyl alcohol is present in the form of an emulsion stabilizer for the polymer.

5. An aqueous composition comprising polyvinyl alcohol, a mineral acid or an ammonium salt thereof, wherein the mineral acid has a pKa of at most 4.0, and an aqueous dispersion of a polymer in which vinyl acetate units constitute at least 60 wt % of the polymer, wherein the composition does not contain units of any N-methylol-containing monomer, wherein at least a portion of the polyvinyl alcohol is present in the form of an emulsion stabilizer for the polymer, wherein none of the polymer and none of the polyvinyl alcohol are on a surface of a non-woven substrate, and wherein the aqueous composition is suitable for application to a non-woven substrate to increase its wet tensile strength.

6. An aqueous composition comprising polyvinyl alcohol, a mineral acid or an ammonium salt thereof, wherein the mineral acid has a pKa of at most 4.0, and an aqueous dispersion of a polymer in which vinyl acetate units constitute at least 60 wt% of the polymer, wherein the composition does not contain units of any N-methylol-containing monomer, wherein at least a portion of the polyvinyl alcohol is present in the form of an emulsion stabilizer for the polymer, wherein all of the polymer and polyvinyl alcohol are fluidly dispersed in the aqueous composition, and wherein the aqueous composition is suitable for application to a non-woven substrate to increase its wet tensile strength.

7. The aqueous composition of claim 1, wherein the aqueous composition has a total solids content of said polymer, polyvinyl alcohol and mineral acid or salt thereof of from 0.5% to 30%.

8. The aqueous composition of claim 5, wherein the aqueous composition has a total solids content of said polymer, polyvinyl alcohol and mineral acid or salt thereof of from 0.5% to 30%.

9. The aqueous composition of claim 6, wherein the aqueous composition has a total solids content of said polymer, polyvinyl alcohol and mineral acid or salt thereof of from 0.5% to 30%.

10. The aqueous composition of claim 7, wherein the mineral acid is selected from the group consisting of HCl, $HNO_3$, $H_2SO_4$, $H_3PO_4$ and $HClO_4$.

11. The aqueous composition of claim 8, wherein the mineral acid is selected from the group consisting of HCl, $HNO_3$, $H_2SO_4$, $H_3PO_4$ and $HClO_4$.

12. The aqueous composition of claim 9, wherein the mineral acid is selected from the group consisting of HCl, $HNO_3$, $H_2SO_4$, $H_3PO_4$ and $HClO_4$.

* * * * *

UNITED STATES PATENT AND TRADEMARK OFFICE

CERTIFICATE OF CORRECTION

PATENT NO. : 9,340,908 B2
APPLICATION NO. : 13/313437
DATED : May 17, 2016
INVENTOR(S) : John Richard Boylan et al.

It is certified that error appears in the above-identified patent and that said Letters Patent is hereby corrected as shown below:

In the Claims

Claim 10 should read:

-- The aqueous composition of claim 7, wherein the mineral acid is selected from the group consisting of HCl, $HNO_3$, $H_2SO_4$, $H_3PO_4$ and $HClO_4$. --

Claim 11 should read:

-- The aqueous composition of claim 8, wherein the mineral acid is selected from the group consisting of HCl, $HNO_3$, $H_2SO_4$, $H_3PO_4$ and $HClO_4$. --

Claim 12 should read:

-- The aqueous composition of claim 9, wherein the mineral acid is selected from the group consisting of HCl, $HNO_3$, $H_2SO_4$, $H_3PO_4$ and $HClO_4$. --

Signed and Sealed this
Second Day of August, 2016

Michelle K. Lee

Michelle K. Lee
*Director of the United States Patent and Trademark Office*